United States Patent [19]

Wurtz

[11] Patent Number: 4,469,445

[45] Date of Patent: Sep. 4, 1984

[54] WALL SCRAPING MIXING TOOL

[75] Inventor: William O. Wurtz, Paramus, N.J.

[73] Assignee: Willowtech, Inc., Paramus, N.J.

[21] Appl. No.: 435,639

[22] Filed: Oct. 21, 1982

[51] Int. Cl.[3] ..... B01F 7/04

[52] U.S. Cl. ..... 366/300; 366/313; 366/325; 366/343

[58] Field of Search ..... 366/300, 309, 311, 312, 366/313, 343, 64, 65, 66, 67

[56] References Cited

U.S. PATENT DOCUMENTS

| | | | |
|---|---|---|---|
| 988,261 | 3/1911 | Griere | 366/325 X |
| 1,215,526 | 2/1917 | Hansen | 366/313 X |
| 1,366,777 | 1/1921 | Flowers | 366/311 |
| 1,369,053 | 2/1921 | Scott | 366/311 X |
| 2,510,057 | 6/1950 | Baker et al. | 366/312 X |
| 3,417,485 | 12/1968 | Saxon | 366/309 X |
| 3,941,357 | 3/1976 | Wurtz | 366/300 X |
| 3,945,616 | 3/1976 | Lodige et al. | 366/325 X |
| 4,214,376 | 7/1980 | Lücke et al. | 366/313 X |
| 4,229,110 | 10/1980 | Lucke | 366/343 |

FOREIGN PATENT DOCUMENTS

| | | | |
|---|---|---|---|
| 1096873 | 1/1961 | Fed. Rep. of Germany | 366/66 |

*Primary Examiner*—Philip R. Coe

*Attorney, Agent, or Firm*—Collard, Roe & Galgano

[57] ABSTRACT

A wall scraping mixing tool for mixing, drying or reacting dry materials, semi-dry materials, or viscous, pasty materials with or without fillers or fibers, within the walls of a mixing container having a main shaft, and at least one support arm coupled to said main shaft. The mixing tool has a generally flat, rectangular plate mounted perpendicular to the radial plane of the support arm having a forward straight edge disposed adjacent to the container wall and a rear edge disposed away from the container wall so that the rectangular plate is inclined with respect to the container wall. There are two substantially triangular planes disposed on the rectangular plate, having side surfaces inclined relative to each other and connected at one edge thereof forming a wedge-shaped double-sided body for connection to the end of the support arm. The forward edges define a point located on the forward straight edge of the plate. The point rotates in the radial plane of the support arm connected to the main shaft of the mixing container. The side surfaces may be concave or convex in shape, and the tool can be constructed from a one piece casting of metal or fabricated as a weldment.

7 Claims, 5 Drawing Figures

WALL SCRAPING MIXING TOOL

The present invention relates to a new wall scraping, mixing tool for mixers, dryers or reactors.

More specifically, the present invention relates to a mixing tool which is well suited for use in single shaft, dual shaft, batch or continuous mixers (dryers, reactors). More particularly and additionally, the present invention relates to a wall scraping mixing tool for mixing, drying or reacting a variety of materials in single or dual shaft mixing containers, these containers being trough shaped, cylindrical in form, or having the form of a vertically-shaped cone.

In U.S. Pat. No. 3,941,357, granted to the applicant, a mixing apparatus is disclosed which permits accurate mixing of all types of material from dry to semi-solid, and particularly of viscous liquids with or without fillers or fibers. The apparatus comprised a container, main drive shafts and a plurality of double wedge mixing tools, each tool having two substantially triangular planes inclined relative to each other and connected at the edge thereof, the mixing tools being connected to the periphery of each shaft in a spaced-apart relationship.

This mixing tool is excellent for use in handling heavy, tacky, viscous materials and incorporating fillers and fibers into these materials. However, the cost to fabricate this mixing tool is relatively high, since the underside of the mixing tool is contoured to match the diameter of the mixer container. Therefore, as a result of increased diameter, and the necessity to contour the underside to the new diameter, another different shaped mixing tool must be fabricated. These tools are not interchangeable, so different sets are required for every different diameter mixing machine offered.

The present invention recognizes the need for a new mixing tool that can be fabricated at low cost, be interchangeable and be used in mixer containers of varying diameter, and provide the similar, intensive mixing action for mixing, drying or reacting a variety of materials.

In examining the design characteristics of mixing tools presently offered to industry, it was noted that these mixing tools generally consist of paddles, scoops, helices, interrupted helices and unilateral or bilateral plowshare-like mixing elements. These mixing elements are generally fixed to their arms at an angle to the plane of rotation of the mixing element arm. Since it is angularly disposed, the bottom edge must be contoured to the diameter of the mixer container wall to insure movement of material lying closely adjacent to the wall. This construction of contouring to the container wall is more expensive to fabricate as compared to the newly-invented mixing tool. Additionally, these contoured mixing elements are not interchangeable with mixing elements designed for containers of different diameter.

Accordingly, it is an object of this invention to provide a novel mixing tool of different design as compared to those in use.

It is another object to take advantage of the double-wedge mixing tool design, as disclosed in U.S. Pat. No. 3,941,357, to permit rapid and intensive mixing of a variety of materials, with a mixing tool which does not have to be contoured to the diameter of the container wall.

It is a further object to provide a tool with near contact between the forward straight edge segment of the mixing tool and the container wall such that the new mixing tool provides a wall scraping action, thereby minimizing or eliminating container wall retention of material and wall build-up.

It is another object of the present invention to provide a mixing tool which is simple in design, easy to fabricate and reliable in operation.

Other objects and features of the present invention will become apparent from the following detailed description considered in connection with the accompanying drawings which disclose several embodiments of the invention. It is to be understood however that the drawings are designed for the purpose of illustration only and not as a definiton of the limits of the invention.

In the drawings wherein similar reference characters denote similar elements throughout the several views.

Referring to FIGS. 1–5, there is shown a section of a conventional stationary mixing container 10 for single or dual shaft mixers (see FIG. 5 for dual shaft apparatus), dryers or reactors, which container can be trough-shaped or cylindrical and including mixing tool arms 11, which radiate from the main shaft 12, being axially and angularly displaced relative to each other. Supporting arms 11 are preferably welded or bolted perpendicular to the main shaft and so set that the entire surface of the mixing container is swept by the mixing tools 13. Wall scraping mixing tools 13 are fixed to the support arm, so that they are perpendicular to the support arm and parallel to main shaft 12.

Figure 1:
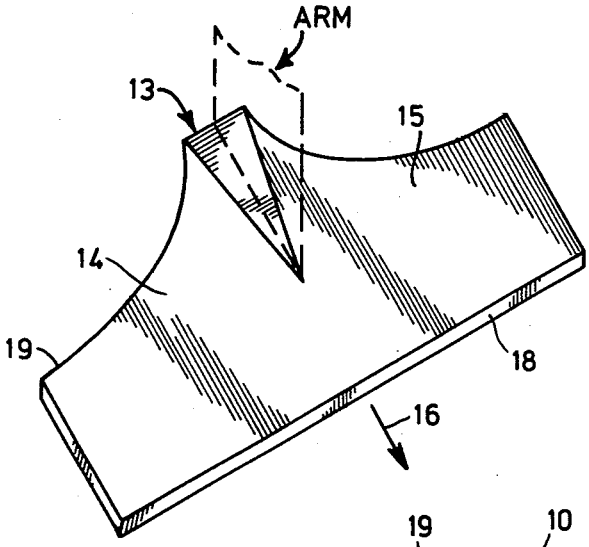
FIG. 1 is a detailed view of a full mixing tool of the present invention.
Figure 2:
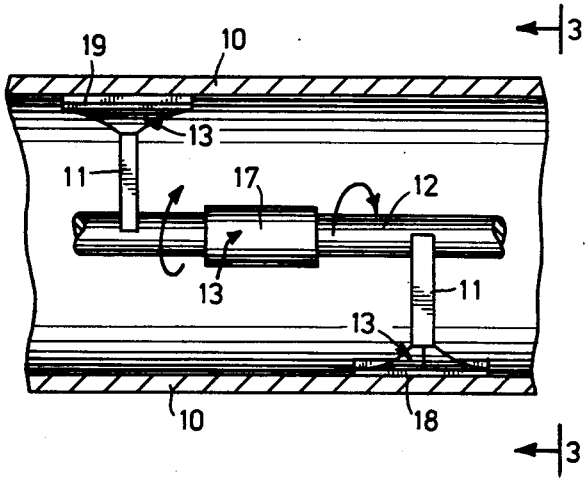
FIG. 2 is a side elevational view of a section of a horizontal mixing container showing the main shaft, mixing tool arms and several mixing tools of the present invention.
Figure 3:
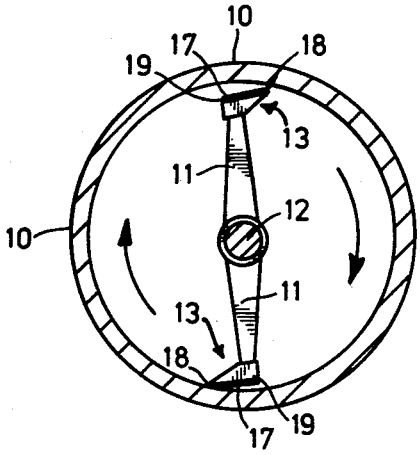
FIG. 3 is a cross-sectional view taken along line 3—3 of FIG. 2.
Figure 5:
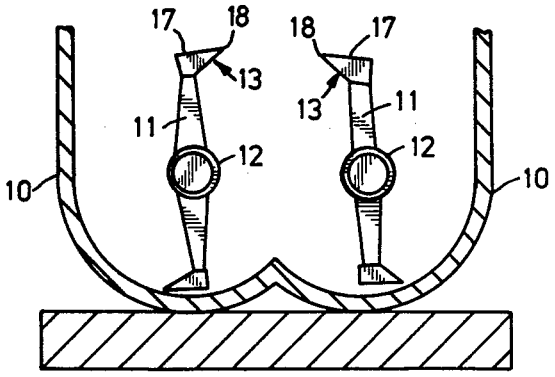
FIG. 5 is a cross-sectional view of a horizontal mixing container similar to the mixing container of FIG. 3 but having two troughs.
Figure 4:
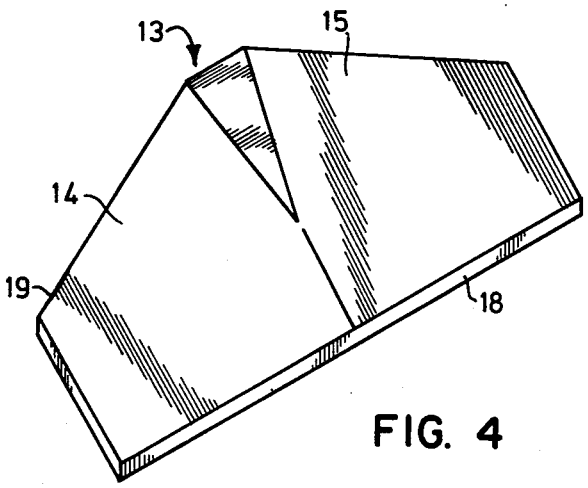
FIG. 4 is a detailed view of a modified version of a mixing tool of the present invention.

The wall scraping mixing tool 13 has three components. There are two mutually inclined surfaces 14 and 15, which face forwardly relative to the direction of rotation 16 of the mixing tool. These inclined surfaces 14 and 15 generally define a double-wedge. This wedge is coupled to a flat, generally rectangular plate 17, the plate having a forward straight edge 18. Alternately, the double-wedge shape can have convex or flat inclined faces, as well as the concave face illustrated in FIG. 1. The double wedge shape having flat inclined faces is shown in FIG. 4 wherein like numerals denote like parts as in FIG. 1. Also, the new mixing tool can be cast as one piece, as an alternate to a weldment.

Mixing tool 13 is fixed to the support arm so that its forward straight edge 18 can be set in close tolerance to the container wall 10, a projection of said straight edge to the wall forming a line segment longitudinally on the container wall. The rear edge 19 of mixing tool 13 is set at an angle to an imaginary line tangent to the container or perpendicular to the support arm in the direction of rotation 16, so that the rear edge is elevated from the container wall. This angle of inclination not only permits scraping of the wall but also produces eddy currents between the tool and the wall when operating at peripheral speeds which are double or triple conventional mixers. These eddy currents tend to loosen and pull material off of the wall, as compared to compression against the wall which is typical of mixing tools that are contoured to the container diameter.

Not only does the new mixing tool scrape the container wall, but it is also capable of impelling material in the same manner as taught in applicant's U.S. Pat. No. 3,941,357, that is, lifting material away from the container walls, impelling individual particles obliquely toward the main shaft, resulting in a rapid and accurate co-mingling of materials of varying particle size, shape and weight.

There are major advantages of the new invention which relate to the cost to fabricate and its interchangeability. Other advantages are in the mixing and reacting of materials that must be completely removed from the mixing container, such as those whose viscosity increases with time or solidify with time.

The new mixing tool can be fabricated as a weldment or be investment cast with no consideration given to contouring the bottom edge like conventional mixing tools, thereby affording savings in manufacturing cost. Also, one tool, or a family of up to three different size tools, all with the same geometry, can satisfy the requirements for a multitude of container diameters, such as, for example, from 4" to 96". This enables limited stocking of parts and the ability to meet delivery commitments quickly.

Many mixing applications are time dependent and material must be efficiently removed from batch or continuous mixers before specific reactions take place. The wall scraping action coupled with the high intensity and speed of mixing permits this type of process, whereas others do not.

While only a few embodiments of the present invention have been shown and described, it will be obvious to those skilled in the art that many changes and modifications may be made thereunto, without departing from the spirit and scope of the invention.

What is claimed is:

1. A wall scraping mixing tool for mixing, drying or reacting dry materials, semi-dry materials, or viscous, pasty materials with or without fillers or fibers, within the walls of a mixing container having a main shaft, and at least one support arm coupled to said main shaft, comprising:

a generally flat, rectangular plate mounted perpendicular to the radial plane of the support arm having a forward straight edge disposed adjacent to the container wall and a rearward straight edge located opposite and parallel to said forward straight edge disposed away from the container wall so that the rectangular plate is inclined with respect to the container wall; and two side surfaces, disposed on said rectangular plate, inclined relative to each other and connected at one edge thereof forming a wedge-shaped double-sided body for connection to the end of the support arm, the forward edges forming a point located on the forward straight edge of said plate, said point rotating in the radial plane of the support arm.

2. The wall scraping mixing tool as recited in claim 1, wherein said side surfaces are concave.

3. The wall scraping mixing tool as recited in claim 1 wherein said tool is constructed of a one piece metal.

4. An apparatus for mixing viscous materials comprising:

a container;

a main shaft disposed through said container and rotatably mounted within said container;

at least one support arm radiating from said main shaft angularly and axially displaced in a spaced-apart relationship;

wall scraping and impelling means comprising at least one generally flat, rectangular plate mounted perpendicular to the radial plane of the support arm having a forward straight edge disposed adjacent to the container wall and being inclined with respect to the container wall, and two side surfaces, disposed on said rectangular plate, inclined relative to each other and connected at one edge thereof forming a wedge-shaped double-sided body for connection to the end of the support arm, the forward edges forming a point located on the forward straight edge of said plate, said point rotating in the radial plane of the support arm; and, drive means coupled to said shaft.

5. The apparatus as recited in claim 4, wherein said container is of trough or cylindrical configuration.

6. The apparatus as recited in claim 4, wherein said container comprises two cylinders, two parallel shafts and two sets of mixing tools, said shafts moving oppositely with respect to each other, so as to co-act in mixing difficult to handle materials.

7. The wall scraping mixing tool as recited in claim 1, wherein said side surfaces are flat.

* * * * *